US009555868B2

(12) United States Patent
Yasukawa et al.

(10) Patent No.: US 9,555,868 B2
(45) Date of Patent: Jan. 31, 2017

(54) BOAT PROPULSION DEVICE

(71) Applicant: YAMAHA HATSUDOKI KABUSHIKI KAISHA, Iwata-shi, Shizuoka (JP)

(72) Inventors: Hikaru Yasukawa, Shizuoka (JP); Kouichi Isozaki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 428 days.

(21) Appl. No.: 14/449,245

(22) Filed: Aug. 1, 2014

(65) Prior Publication Data

US 2015/0151822 A1 Jun. 4, 2015

(30) Foreign Application Priority Data

Nov. 29, 2013 (JP) ..... 2013-248258

(51) Int. Cl.

| | |
|---|---|
| ***B63H 20/00*** | (2006.01) |
| ***B63H 20/32*** | (2006.01) |
| ***B63H 23/34*** | (2006.01) |
| ***F02P 15/00*** | (2006.01) |
| ***F02F 1/24*** | (2006.01) |
| ***F02P 13/00*** | (2006.01) |
| *H01T 13/04* | (2006.01) |
| *F02B 61/04* | (2006.01) |

(52) U.S. Cl.

CPC ..... *B63H 20/32* (2013.01); *B63H 20/00* (2013.01); *B63H 23/34* (2013.01); *F02F 1/242* (2013.01); *F02P 13/00* (2013.01); *F02P 15/001* (2013.01); *F02B 61/045* (2013.01); *F02D 2400/21* (2013.01); *H01T 13/04* (2013.01)

(58) Field of Classification Search

CPC ..... H01T 13/04; H01T 13/05; B63H 20/32; B63H 20/00; B63H 23/34; F02F 1/242; F02P 13/00; F02P 15/00; F02P 15/001; F02P 15/02

See application file for complete search history.

(56) References Cited

U.S. PATENT DOCUMENTS 5,168,842 A * 12/1992 Brooks ..... H01T 13/04 123/143 C
5,960,770 A * 10/1999 Taue ..... F02B 33/26 123/197.3

FOREIGN PATENT DOCUMENTS

JP 2-230965 A 9/1990

* cited by examiner

*Primary Examiner* — Jacob Amick
(74) *Attorney, Agent, or Firm* — Keating and Bennett, LLP

(57) ABSTRACT

In a boat propulsion device, a head portion of an engine includes plug holes, first attachment portions, and a second attachment portion. The plug holes are aligned vertically and parallel or substantially parallel to a crankshaft. The first attachment portions are arranged on the periphery of the plurality of plug holes. The first attachment portions are configured to attach a plurality of ignition coils which are respectively integrated with spark plugs in a coil-on-plug configuration. A second attachment portion is provided separately from the first attachment portions. The second attachment portion is configured to attach an ignition coil connected to the spark plugs in a double ended ignition coil configuration via cables.

7 Claims, 11 Drawing Sheets

BOAT PROPULSION DEVICE

BACKGROUND OF THE INVENTION

1. Field of the Invention

The present invention relates to a boat propulsion device.

2. Description of the Related Art

There are two types of engines for boat propulsion devices: engines which use spark plugs in a coil-on-plug configuration, and engines which use spark plugs in a double ended ignition coil configuration. For example, Japan Patent Laid-open Patent Publication JP-A-02-230965 discloses an engine provided with an ignition device with a coil-on-plug configuration.

In the coil-on-plug configuration, an ignition coil is incorporated with a spark plug, and controlling the conduction of current through each ignition coil controls the spark timing for each spark plug independently. On the other hand, in a double ended ignition coil configuration the ignition coil and spark plug are separate. The plurality of spark plugs in a double ended ignition coil configuration is connected to the same ignition coil via a cable. Controlling the conduction of current through the shared ignition coil ensures that multiple spark plugs will spark simultaneously with great accuracy.

SUMMARY OF THE INVENTION

Recently there has been a desire in manufacturing to control production costs by standardizing components. However, standardizing the components for double ended ignition coil configurations and coil-on-plug configurations in which the spark plugs and ignition coils have different structures is no simple task.

Preferred embodiments of the present invention address this problem by providing a boat propulsion device wherein spark plugs may be used in either double ended ignition coil configurations or coil-on plug configurations, and wherein the standardizing of components leads to reduced production costs.

A boat propulsion device according to a preferred embodiment of the present invention includes an engine, a drive shaft, and a propeller shaft. The engine includes a crankshaft and a head portion. The crankshaft extends vertically. The head portion is arranged horizontally adjacent to the crankshaft. The drive shaft extends vertically and is connected to the crankshaft. The propeller shaft extends horizontally and is connected to the drive shaft. The head portion includes a plurality of plug holes, a plurality of first attachment portions, and a second attachment portion. The plurality of plug holes is aligned vertically, parallel or substantially parallel to the crankshaft. The plurality of first attachment portion is arranged on the periphery of the plurality of plug holes. The first attachment portions are configured to attach a plurality of integrated ignition coils which are respectively integrated with the plurality of spark plugs in a coil-on-plug configuration. A second attachment portion is provided separately from the first attachment portions. The second attachment portion is configured to attach a separated ignition coil connected to the spark plugs in a double ended ignition coil configuration via cables.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
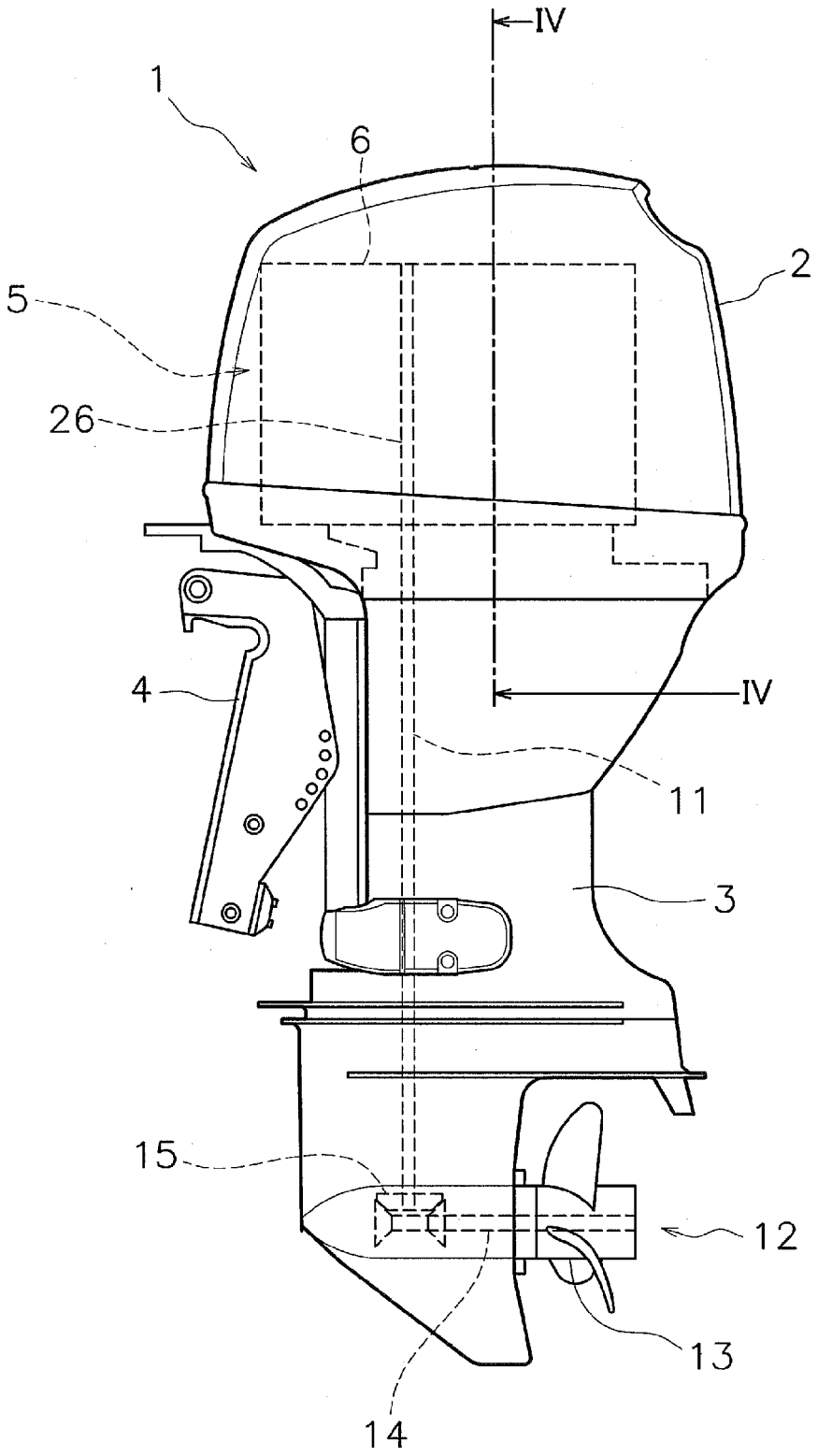
FIG. 1 is a side view of a boat propulsion device according to a preferred embodiment of the present invention.

Various preferred embodiments of a boat propulsion device will be described below with reference to the drawings. FIG. 1 is a side view of a boat propulsion device 1 according to a preferred embodiment of the present invention. The boat propulsion device 1 is preferably an outboard motor, for example. The boat propulsion device 1 includes an engine cover 2, a casing 3, a bracket 4, and an engine unit 5. The engine cover 2 houses the engine unit 5. The casing 3 is arranged below the engine cover 2. The boat propulsion device 1 is attached to a hull via the bracket 4.

The engine unit 5 is placed inside the engine cover 2. The engine unit 5 includes an engine 6. A drive shaft 11 is arranged inside the casing 3. The drive shaft 11 extends vertically inside the casing 3. The drive shaft 11 is fixed to a crankshaft 26 of the engine 6. A propeller 12 is arranged at the lower portion of the casing 3. The propeller 12 is arranged below the engine 6. The propeller 12 includes a propeller hub 13. A propeller shaft 14 is arranged inside the propeller hub 13. The propeller shaft 14 extends longitudinally. The propeller shaft 14 is coupled to the lower portion of the drive shaft 11 through a bevel gear 15.

In the boat propulsion device 1, the drive shaft 11 and the propeller shaft 14 transfer the driving power produced by the engine 6 to the propeller 12. The driving power transferred to the propeller 12 causes the propeller 12 to rotate forwards or backwards. This forwards or backwards rotation of the propeller 12 produces travel power that causes a boat provided with the boat propulsion device 1 to travel forward or backward.

Figure 2:
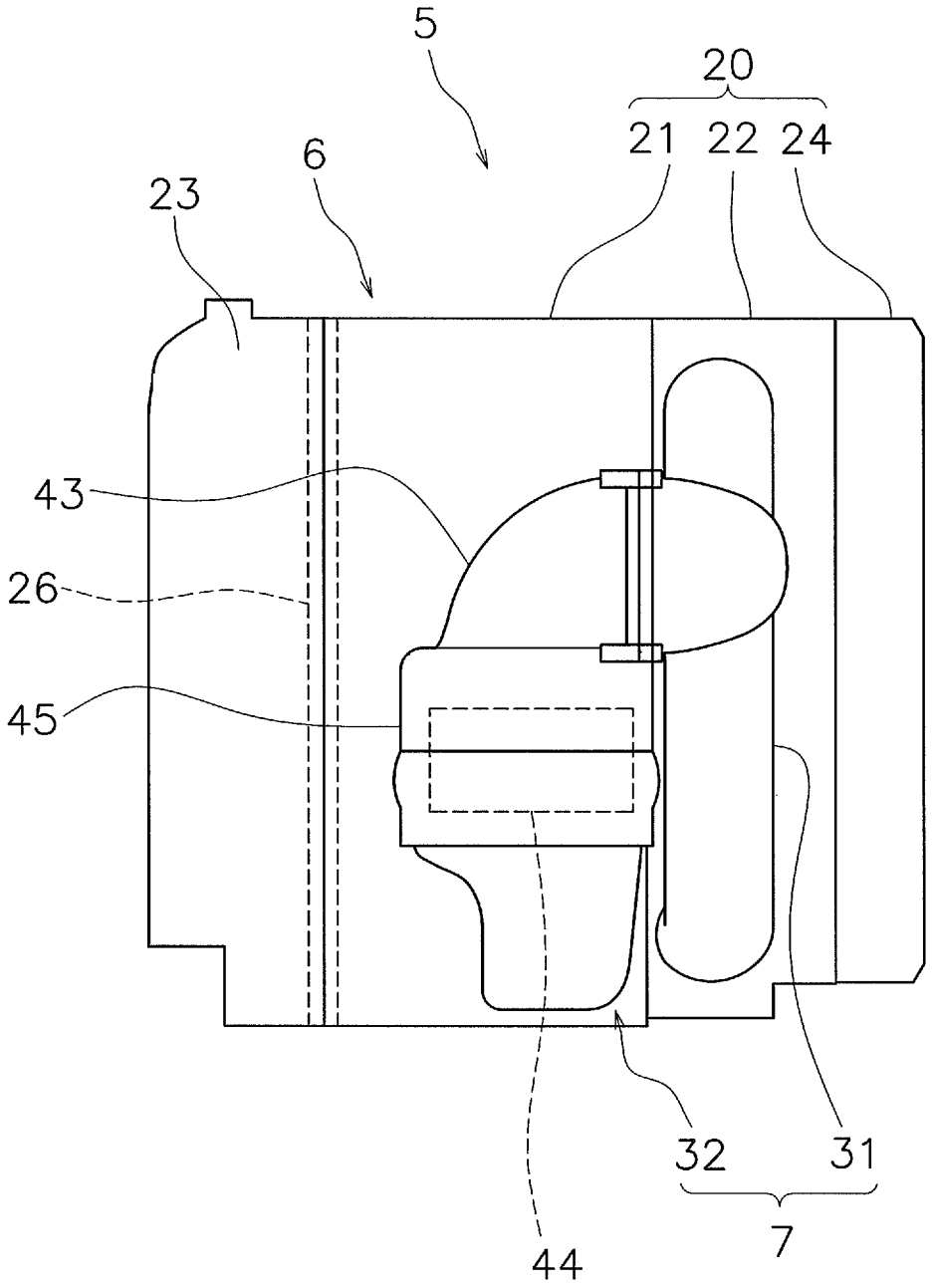
FIG. 2 is a side view of an engine unit.

FIG. 2 is a side view of the engine unit 5. As illustrated in FIG. 2, the engine 6 includes a head portion 20 and a crankcase 23. The head portion 20 is arranged horizontally adjacent to the crankshaft 26. The head portion 20 includes a cylinder block 21, a cylinder head 22, and a head cover 24. The cylinder head 22 is arranged behind the cylinder block 21. The head cover 24 is arranged behind the cylinder head 22. The crankcase 23 is arranged in front of the cylinder block 21.

The crankshaft 26 is arranged inside the crankcase 23. The crankshaft 26 extends vertically. The upper end portion of the drive shaft 11 is coupled to the lower end portion of the crankshaft 26. The movement of a plurality of pistons (not shown) arranged inside the cylinder block 21 is transmitted to the drive shaft 11 via the crankshaft 26.

The engine unit 5 includes an exhaust pipe 7. The exhaust pipe 7 is arranged beside the engine 6. The exhaust pipe 7 is connected to the engine 6. More specifically, the exhaust pipe 7 includes an exhaust manifold 31 and a catalyst unit 32. The exhaust manifold 31 is connected to the engine 6. The catalyst unit 32 is connected to the exhaust manifold 31. The exhaust manifold 31 is arranged beside the cylinder head 22. The exhaust manifold 31 extends vertically. The exhaust manifold 31 is connected to the cylinder head 22.

The catalyst unit 32 is arranged beside the cylinder block 21. The catalyst unit 32 includes a connecting tube 43, catalyst member 44, and a catalyst storage tube 45. The connecting tube 43 is connected to the catalyst storage tube 45. The connecting tube 43 is located above the catalyst storage tube 45. The connecting tube 43 connects the catalyst storage tube 45 and the exhaust manifold 31. The connecting tube 43 is shaped to curve from the upper end of the catalyst storage tube 45 toward the exhaust manifold 31.

The catalyst member 44 is arranged inside the catalyst storage tube 45. The catalyst member 44 supports a catalyst that purifies the exhaust. For example, a three-way catalyst is preferably used. The exhaust traveling through the exhaust pipe 7 passes through the catalyst member 44 inside the catalyst storage tube 45 and is purified. The catalyst storage tube 45 is arranged next to the exhaust manifold 31 in the longitudinal direction of the boat propulsion device 1. The catalyst storage tube 45 is arranged to extend vertically.

Figure 3:
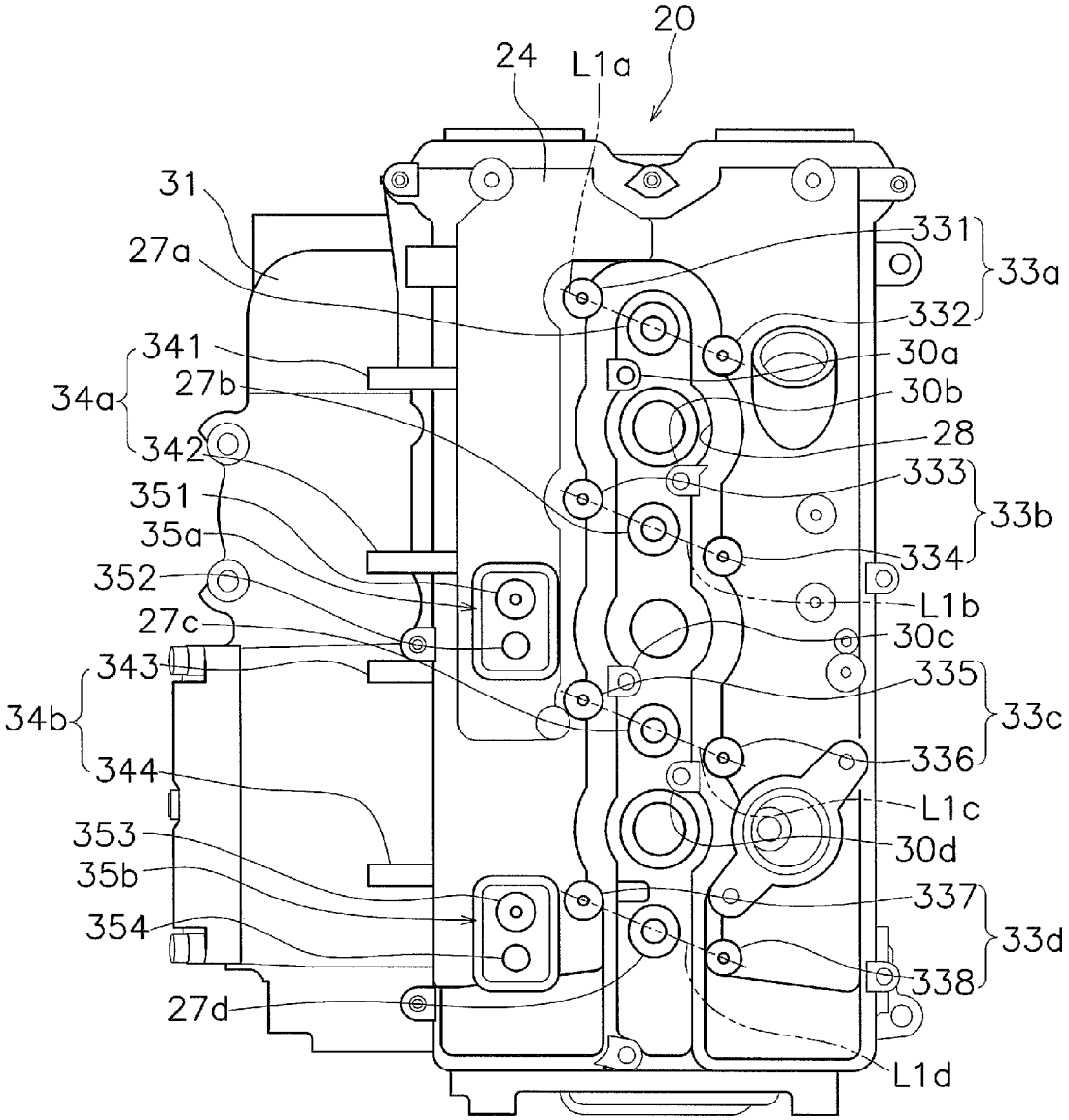
FIG. 3 is a rear view of the engine without a spark plug or ignition coil attached.
Figure 4:
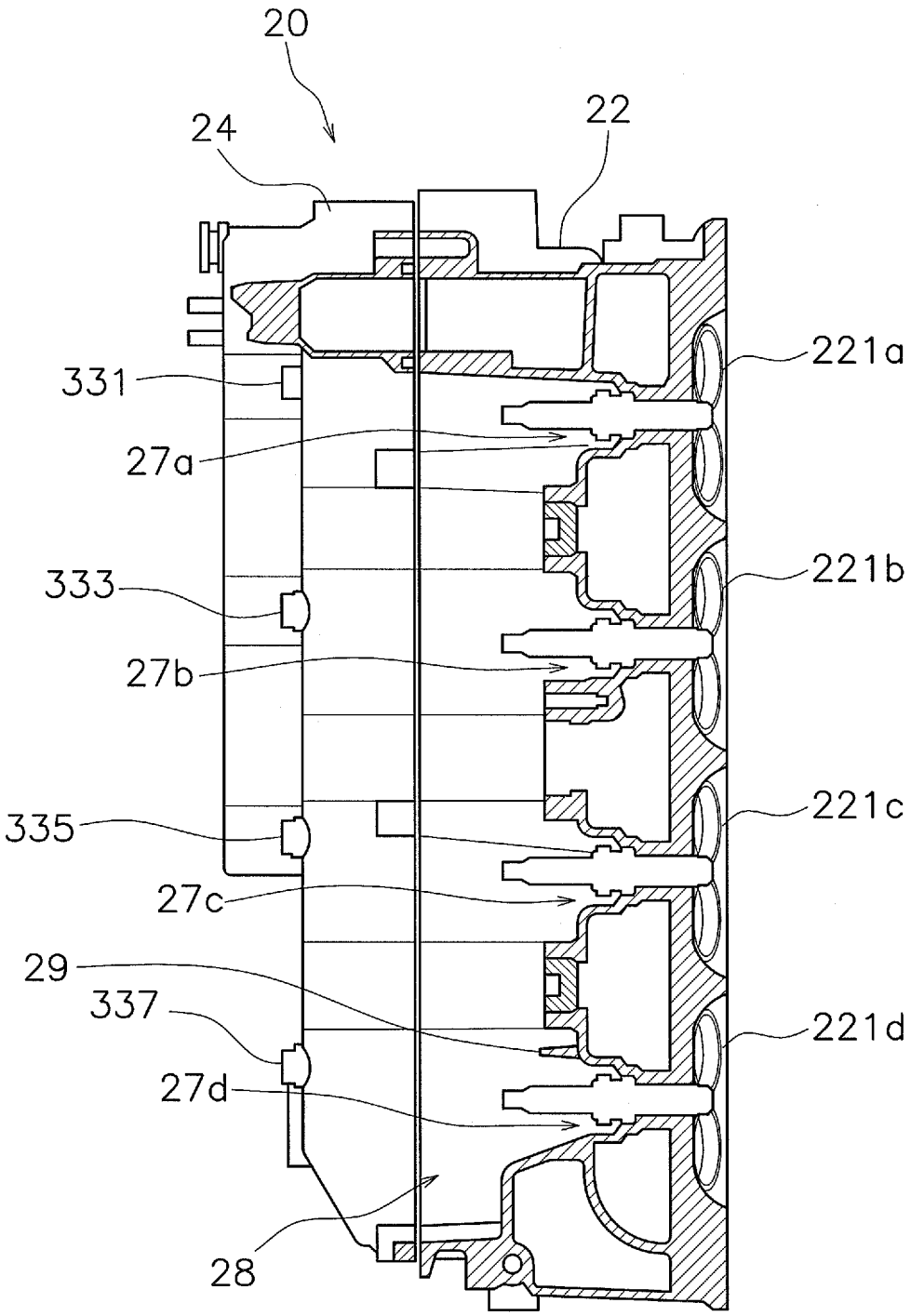
FIG. 4 is a partial cross-sectional view of the engine without the spark plug or ignition coil attached.

FIG. 3 is a rear view of the engine 6 without a spark plug or ignition coil attached. FIG. 4 is a cross-sectional view of the head cover 24 and the cylinder head 22 without the spark plug or ignition coil attached.

As illustrated in FIG. 3 and FIG. 4, the head portion 20 includes a plurality of plug holes 27*a* to 27*d* configured to receive spark plugs. In the present preferred embodiment, the head portion 20 includes a first plug hole 27*a*, a second plug hole 27*b*, a third plug hole 27*c*, and a fourth plug hole 27*d*. The first through fourth plug holes 27*a* to 27*d* are aligned vertically and parallel or substantially parallel to the crankshaft 26. The first through fourth plug holes 27*a* to 27*d* respectively extend in the longitudinal direction. As illustrated in FIG. 3, the first through fourth plug holes 27*a* to 27*d* respectively extend through the head cover 24 and the cylinder head 22 to the combustion chambers 221*a* to 221*d* in the cylinder head 22.

As illustrated in FIG. 3, the head portion 20 includes a vertically extending trench 28. The trench 28 connects the plurality of plug holes 27*a* to 27*d* to each other. As illustrated in FIG. 4, the cylinder head 22 includes a rib 29 between the third plug hole 27*c* and the fourth plug hole 27*d* within the trench 28. As illustrated in FIG. 3, bolt seats 30*a* and 30*b* are provided between the first plug hole 27*a* and the second plug hole 27*b*. Furthermore, a bolt seat 30*c* is provided between the second plug hole 27*b* and the third plug hole 27*c*. A bolt seat 30*d* is provided between the third plug hole 27*c* and the fourth plug hole 27*d*. The bolt seats 30*a* to 30*d* are configured to protrude from the edge of the trench 28 towards the trench 28.

As illustrated in FIG. 3, the head cover 24 includes first attachment portions 33*a* to 33*d* and second attachment portions 34*a* and 34*b*. The first attachment portions 33*a* to 33*d* are configured to attach the plurality of ignition coils (hereafter referred to as "integrated coils") which are respectively integrated with the plurality of spark plugs in a coil-on-plug configuration (described below). The first attachment portions 33*a* to 33*d* correspond to each of the plurality of plug holes 27*a* to 27*d*. Therefore, the same number of first attachment portions 33*a* to 33*d* as a plurality of spark plugs in a coil-on-plug configuration are provided in the head cover 24. The first attachment portions 33*a* to 33*d* are arranged around peripheries of the plurality of plug holes 27*a* to 27*d*. More specifically, the first attachment portion 33*a* arranged on the periphery of the first plug hole 27*a* includes a first fastening hole 331 and a second fastening hole 332. The first plug hole 27*a* is arranged between the first fastening hole 331 and the second fastening hole 332.

Bolts that secure an integrated coil for the coil-on-plug configuration are tightened to the first fastening hole 331 and the second fastening hole 332. The first fastening hole 331 and the second fastening hole 332 are preferably horizontally separated from each other. Further, an imaginary line L1a connecting the centers of the first fastening hole 331 and the second fastening hole 332 preferably slants with respect to the vertical direction. The imaginary line L1a and the first plug hole 27*a* overlaps when the engine 6 is viewed from the rear.

The first attachment portion 33*b* corresponding to the second plug hole 27*b* includes a first fastening hole 333 and a second fastening hole 334. An imaginary line Lib connecting the centers of the first fastening hole 333 and the second fastening hole 334 preferably slants with respect to the vertical direction. The first attachment portion 33*c* corresponding to the third plug hole 27*c* includes a first fastening hole 335 and a second fastening hole 336. Further, an imaginary line L1c connecting the centers of the first fastening hole 335 and the second fastening hole 336 preferably slants with respect to the vertical direction. The first attachment portion 33*d* corresponding to the fourth plug hole 27*d* includes a first fastening hole 337 and a second fastening hole 338. Further, an imaginary line L1d connecting the centers of the first fastening hole 337 and the second fastening hole 338 preferably slants with respect to the vertical direction. The imaginary lines L1a to L1d respectively slant in the same direction and are mutually parallel or substantially parallel. The first attachment portions 33*b* to 33*d* preferably have the same configuration as the above described first attachment portion 33*a*, and therefore a detailed explanation thereof will be omitted.

Second attachment portions 34*a* and 34*b* are provided separately from the first attachment portions 33*a* to 33*d*. The second attachment portions 34*a* and 34*b* are configured to attach the plurality of ignition coils (hereafter, "separated coils"), which are respectively connected to the plurality of spark plugs in a double ended ignition coil configuration (described below) via cables. The number of the second attachment portions 34*a* and 34*b* is smaller than the number of plug holes 27*a* to 27*d*. In the present preferred embodiment, two second attachment portions 34*a* and 34*b* are provided in the head cover 24. However, the head cover 24 may be provided with only a single second attachment portion. The two second attachment portions 34*a* and 34*b* are aligned vertically.

The second attachment portions 34*a* and 34*b* are provided on the side surface of the head cover 24. The second attachment portion 34*a* includes a first support portion 341 and a second support portion 342. Each of the support portions 341 and 342 projects laterally from the side surface of the head cover 24. Each of the supports 341 and 342 is provided with a fastening hole (not shown); where the separated coil in the double ended ignition coil configuration is secured to each of the supports 341 and 342 with bolts. The second attachment portion 34*a* is located below the upper end of the trench 28. The second attachment portion

34*b* is located above the lower end of the trench 28. The second attachment portion 34*b*, which is located below the second attachment portion 34*a*, includes a first support portion 343 and a second support portion 344. The second attachment portion 34*b* preferably has the same configuration as the above described second attachment portion 34*a*, and therefore a detailed explanation thereof will be omitted.

The head portion 20 includes a third attachment portion 35*a* and 35*b*. The third attachment portion 35*a* and 35*b* is configured to attach a cable holder (described below). Two third attachment portions 35*a* and 35*b* are provided in the present preferred embodiment. The third attachment portions 35*a* and 35*b* are aligned vertically. The third attachment portion 35*a* is arranged beside the trench 28 on the head cover 24. The third attachment portion 35*a* is provided between the second attachment portions 34*a* and 34*b* and the trench 28 in the lateral direction.

The third attachment portion 35*b*, which is located below the second attachment portion 35*a*, includes a first projection 353 and a second projection 354. The third attachment portion 35*b* preferably has the same configuration as the above described third attachment portion 35*a*, and therefore a detailed explanation thereof will be omitted.

Figure 5:
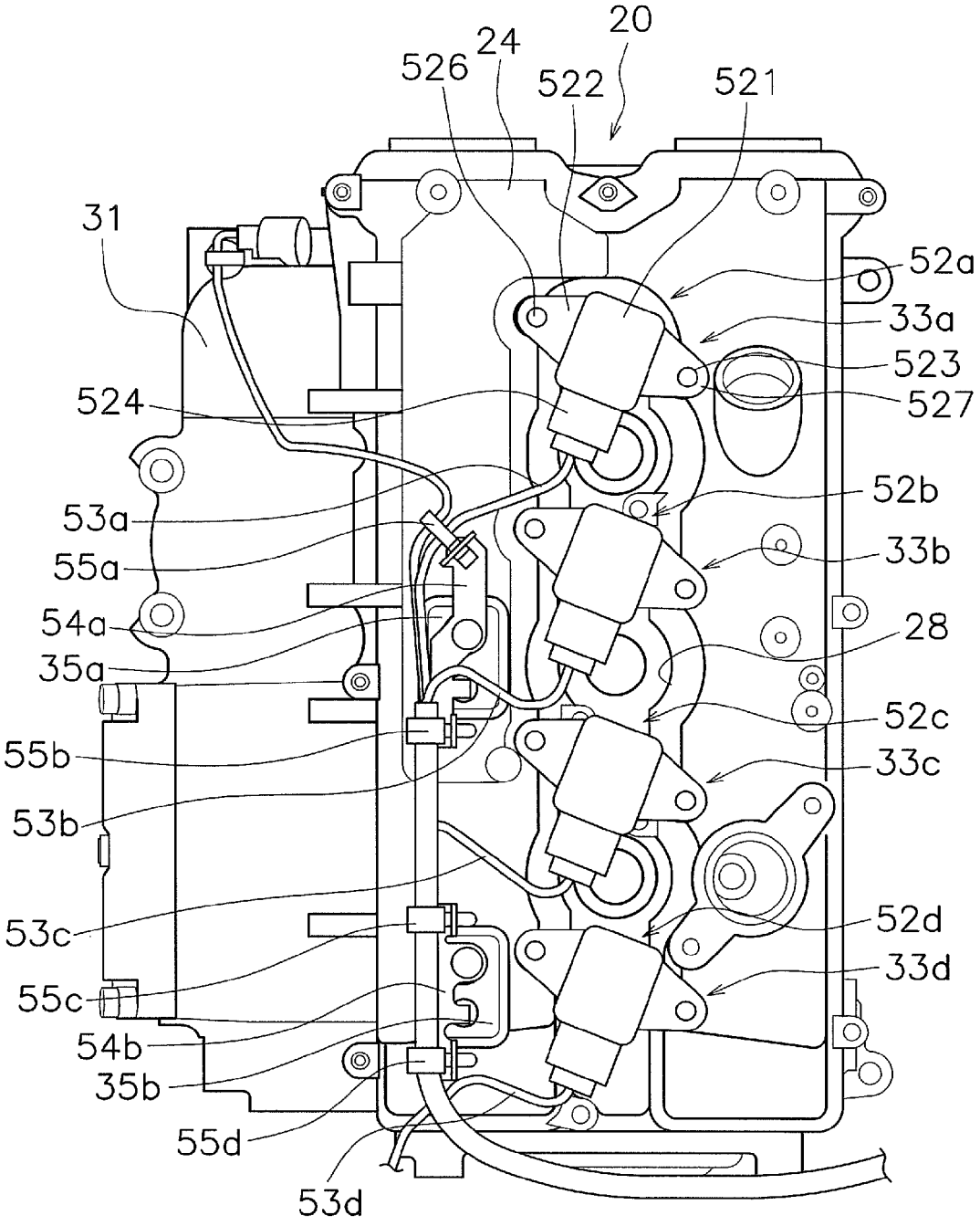
FIG. 5 is a rear view of the engine with a spark plug and integrated ignition coil attached in a coil-on-plug configuration.
Figure 6:
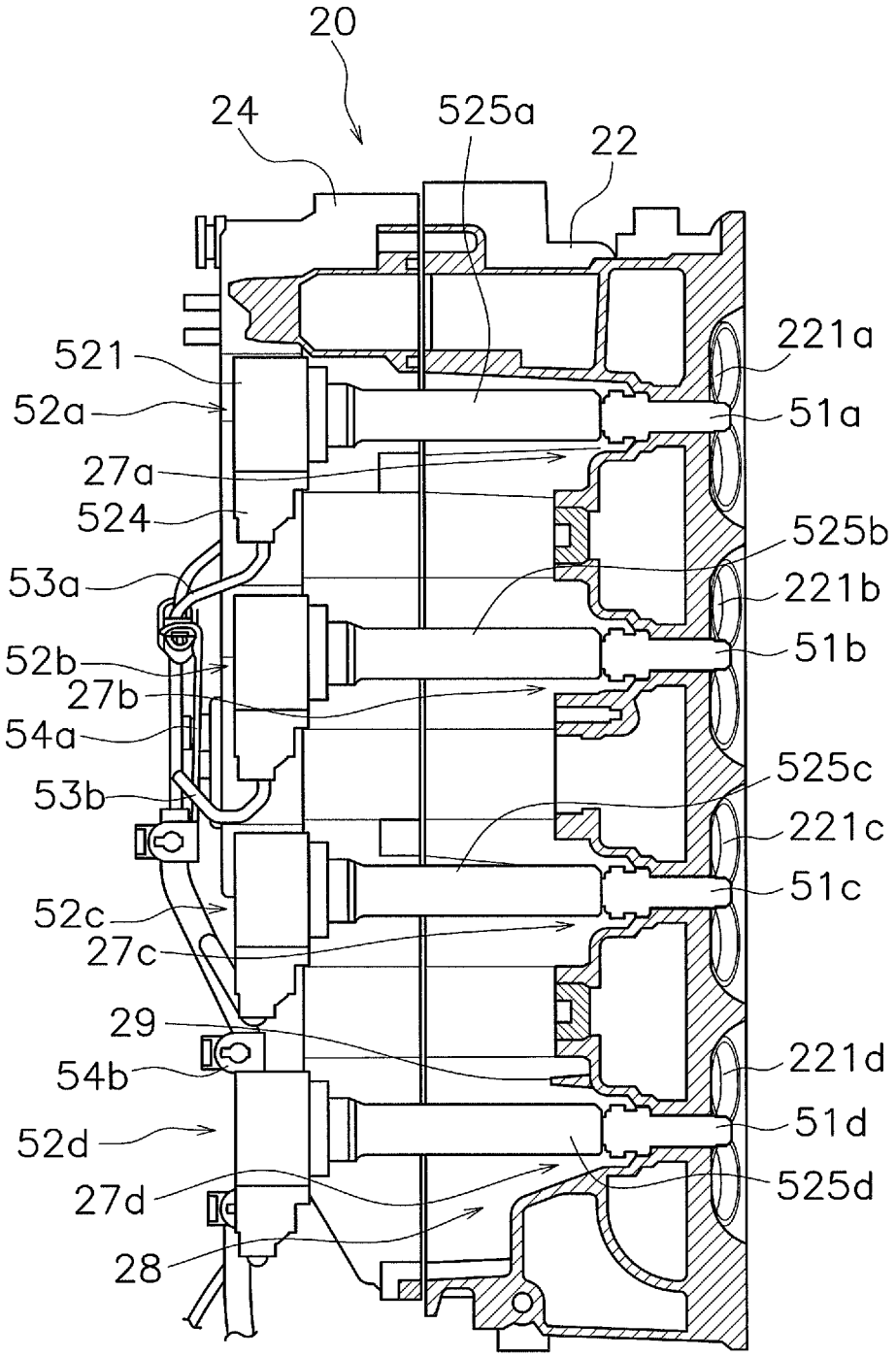
FIG. 6 is a partial cross-sectional view of the engine with the spark plug and integrated ignition coil attached in a coil-on-plug configuration.

FIG. 5 is a rear view of the engine 6 with spark plugs 51*a* to 51*d* and integrated coils 52*a* to 52*d* attached in a coil-on-plug configuration. FIG. 6 is a cross-sectional view of the head cover 24 and the cylinder head 22 with the spark plugs 51*a* to 51*d* and the integrated coils 52*a* to 52*d* attached in the coil-on-plug configuration.

As illustrated in FIG. 6 the plurality of spark plugs 51*a* to 51*d* for the coil-on-plug configuration are plugged into the respective plurality of plug holes 27*a* to 27*d*. More specifically, a first spark plug 51*a* is plugged into the first plug hole 27*a*. Furthermore, a first integrated coil 52*a* is integrated with the first spark plug 51*a*. A second spark plug 51*b* is plugged into the second plug hole 27*b*. Furthermore, a second integrated coil 52*b* is integrated with the second spark plug 51*b*. A third spark plug 51*c* is plugged into the third plug hole 27*c*. Furthermore, a third integrated coil 52*c* is integrated with the third spark plug 51*c*. Finally, a fourth spark plug 51*d* is plugged into the fourth plug hole 27*d*. Furthermore, a fourth integrated coil 52*d* is integrated with the fourth spark plug 51*d*.

While the first spark plug 51*a* and first integrated coil 52*a* will be described below, the second through fourth spark plugs 51*b* to 51*d* and second through fourth integrated coils 52*b* to 52*d* preferably have the same configuration.

As illustrated in FIG. 5, the first integrated coil 52*a* is attached at the first attachment portion 33*a*. The first integrated coil 52*a* includes the coil body 521, a first fixed flange 522, a second fixed flange 523, a connector 524, and a plug boot 525*a*.

The coil body 521 houses windings and an iron core (not shown), and increases the voltage input thereto. The coil body 521 appears square or substantially square when viewed from the rear. The longitudinal direction of the coil body 521 preferably slants with respect to the vertical direction. The coil body 521 is located behind the trench 28.

The first fixed flange 522 protrudes from one side surface of the coil body 521. The second fixed flange 523 protrudes from the other side surface of the coil body 521. The fixed flanges 522 and 523 are configured to attach the first integrated coil 52*a* to the first attachment portion 33*a*. The fixed flanges 522 and 523 have holes provided therein. A bolt 526 extends through the hole in the first fixed flange 522 to attach the first integrated coil 52*a* to the first fastening hole 331 of the first attachment portion 33*a*. A bolt 527 extends through the hole in the second fixed flange 523 to attach the first integrated coil 52*a* to the second fastening hole 332 of the first attachment portion 33*a*.

The connector 524 protrudes from the coil body 521. A first cable 53, which supplies electricity to the coil body 521, is connected to the connector 524. More specifically, the connector 524 protrudes from the lower surface of the coil body 521 in a direction parallel or substantially parallel to the longitudinal direction of the coil body 521. Therefore, the connector 524 protrudes from the coil body 521 in a direction that slants with respect to the vertical direction. More specifically, the connector 524 extends laterally and downward from the coil body 521.

As illustrated in FIG. 6, the plug boot 525*a* protrudes from the coil body 521. The plug boot 525*a* is arranged inside the trench 28. The plug boot 525*a* is preferably made of an insulating material such as rubber. The plug boot 525*a* includes a through hole. The end of the first spark plug 51*a* is inserted into the through hole of the plug boot 525*a* to connect the first spark plug 51*a* and first integrated coil 52*a*.

The first cable 53*a* is connected to the first integrated coil 52*a*. A second cable 53*b* is connected to the second integrated coil 52*b*. A third cable 53*c* is connected to the third integrated coil 52*c*. A fourth cable 53*d* is connected to the fourth integrated coil 52*d*.

The second integrated coil 52*b* includes a plug boot 525*b*. Inserting the end of the second spark plug 51*b* into the through hole of the plug boot 525*b* connects the second integrated coil 52*b* and the second spark plug 51*b*. The third integrated coil 52*c* includes a plug boot 525*c*. Inserting the end of the third spark plug 51*c* into the through hole of the plug boot 525*c* connects the third integrated coil 52*c* and the third spark plug 51*c*. The fourth integrated coil 52*d* includes a plug boot 525*d*. Inserting the end of the fourth spark plug 51*d* into the through hole of the plug boot 525*d* connects the fourth integrated coil 52*d* and the fourth spark plug 51*d*.

Cable holders 54*a* and 54*b* are preferably attached to the third attachment portion 35*a* and 35*b* to hold cables 53*a* to 53*d*. The cable holders 54*a* and 54*b* hold the cables 53*a* to 53*d* which are connected to the integrated coils 52*a* to 52*d*. A first cable holder 54*a* is attached to the third attachment portion 35*a*. A second cable holder 54*b* is attached to the third attachment portion 35*b* which is located lower than the third attachment portion 35*a*.

Figure 7:
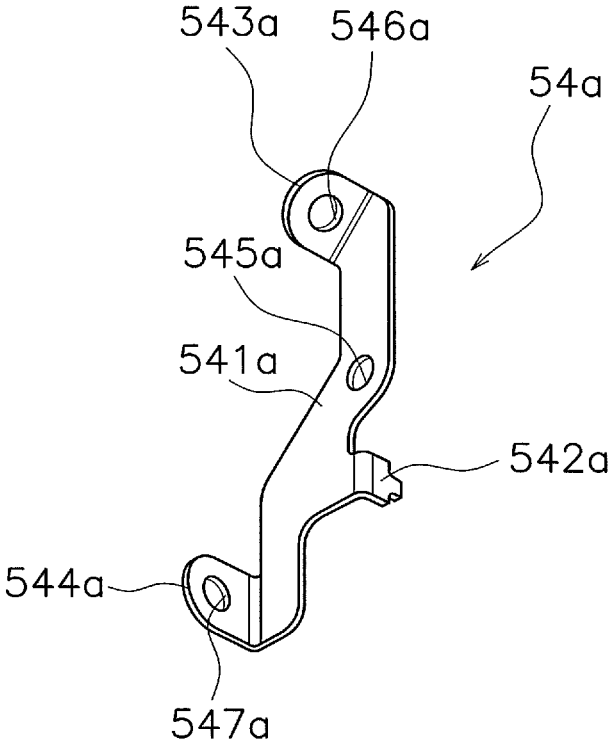
FIG. 7 is a perspective view of a first cable holder.

FIG. 7 is a perspective view of the first cable holder 54*a*. The first cable holder 54*a* includes a first main section 541*a*, a first projection 542*a*, a first holder 543*a*, and a second holder 544*a*. The first main section 541*a* is a vertically extending plate. The first main section 541*a* is provided with a hole 545*a*. The projection 351 on the third attachment portion 35*a* is inserted into the hole 545*a* in the first main section 541*a*. The first projection 542*a* projects in a direction that is orthogonal or substantially orthogonal to the first main section 541*a*. The first holder 543*a* and the second holder 544*a* project in another direction orthogonal or substantially orthogonal to the first main section 541*a*. The first projection 542*a* engages with a recess 352 in the third attachment portion 35*a* to prevent the rotation of the first cable holder 54*a*.

The first holder 543*a* is provided with a hole 546*a*. The second holder 544*a* is provided with a hole 547*a*. A first cable binder 55*a* (refer to FIG. 5) is preferably attached to the first holder 543*a* to bundle cables together. A second cable binder 55*b* (refer to FIG. 5) is preferably attached to the second holder 544*a* to bundle cables together. The first holder 543*a* and the second holder 544*a* are preferably arranged laterally separated from each other to coincide with the position at which the first cable binder 55*a* and the second cable binder 55*b* bundle the cables together.

Figure 8:
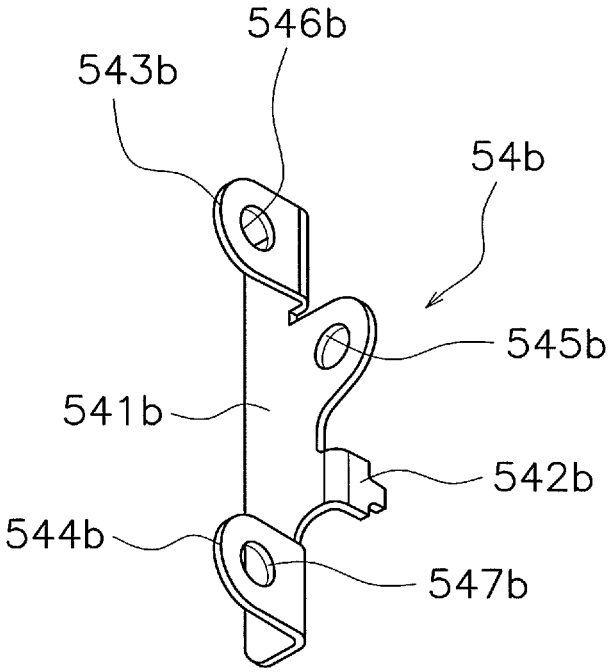
FIG. 8 is a perspective view of a second cable holder.

FIG. 8 is a perspective view of the second cable holder 54*b*. The second cable holder 54*b* includes a second main section 541*b*, second projection 542*b*, third holder 543*b*, and a fourth holder 544*b*. The second main section 541*b* is a vertically extending plate. The second main section 541*b* is provided with a hole 545*b*. The projection 353 on the third attachment portion 35*b* is inserted into the hole 545*b* in the second main section 541*b*. The second projection 542*b* projects toward one direction orthogonal or substantially orthogonal to the second main section 541*b*. The third holder 543*b* and the fourth holder 544*b* project toward the other direction orthogonal or substantially orthogonal to the second main section 541*b*. The second projection 542*b* engages with a recess 354 in the third attachment portion 35*b* to prevent the rotation of the second cable holder 54*b*. The third holder 543*b* is provided with a hole 546*b*. The fourth holder 544*b* is provided with a hole 547*b*. A third cable binder 55*c* (refer to FIG. 5) is preferably attached to the third holder 543*b* to bundle cables together. A fourth cable binder 55*d* (refer to FIG. 5) is preferably attached to the fourth holder 544*b* to bundle cables together. The positions where the third cable binder 55*c* and the fourth cable binder 55*d* bundle cables together are aligned vertically.

Figure 9:
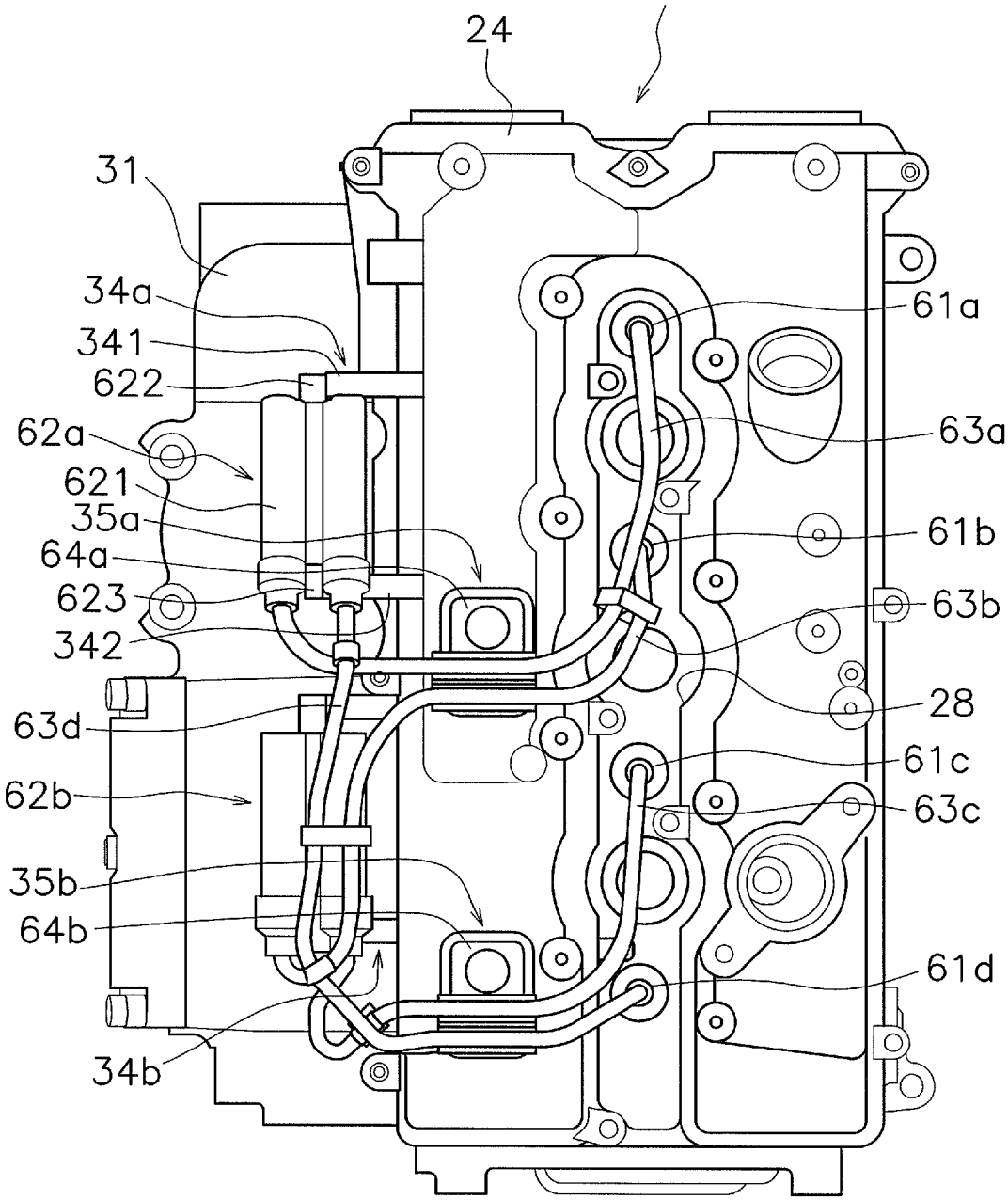
FIG. 9 is a rear view of the engine with a spark plug and separated ignition coil attached in a double ended ignition coil.
Figure 10:
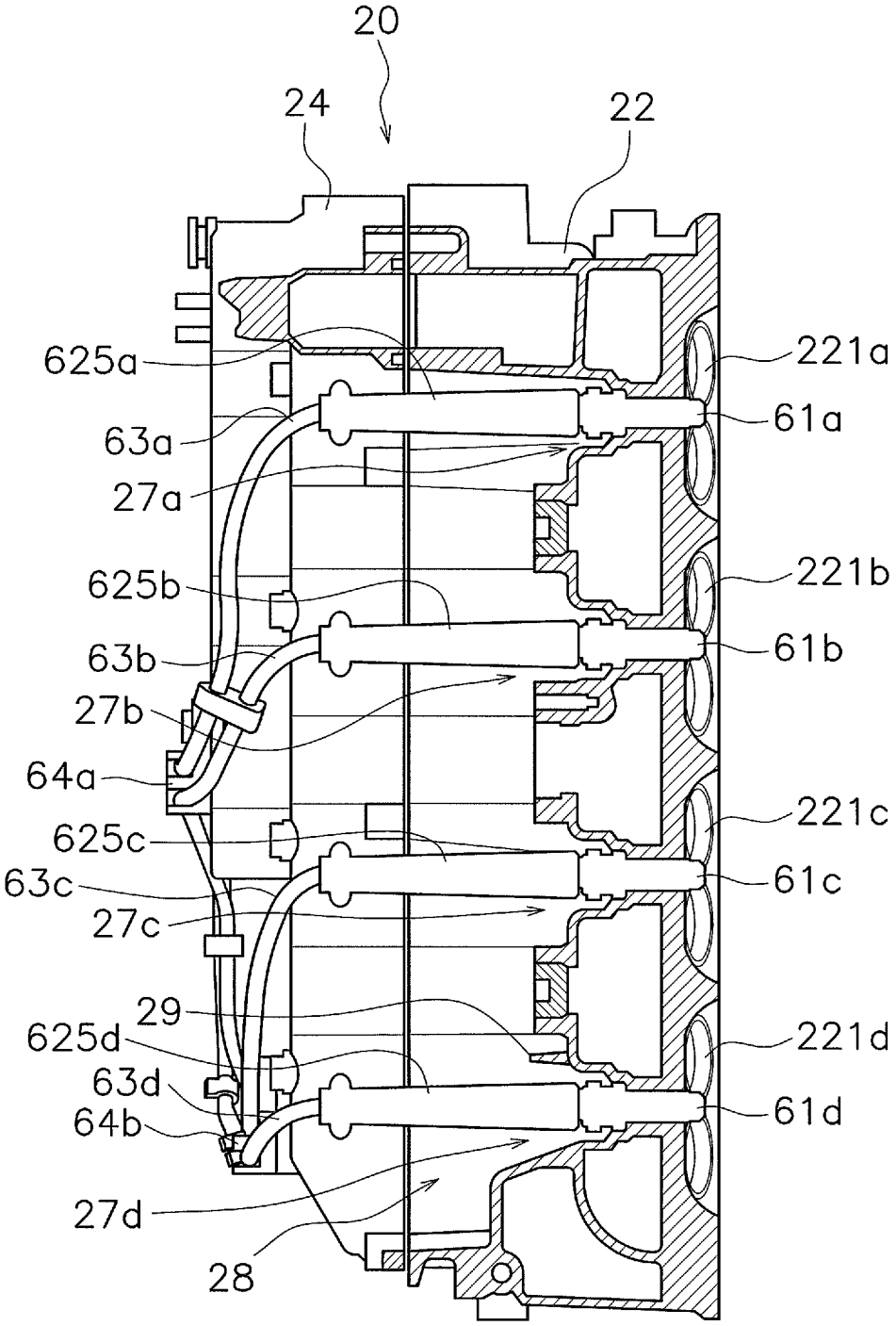
FIG. 10 is a partial cross-sectional view of the engine with the spark plug and separated ignition coil attached in a double ended ignition coil configuration.

FIG. 9 is a rear view of the engine 6 with spark plugs 61*a* to 61*d* and separated coils 62*a* and 62*b* attached in a double ended ignition coil configuration. FIG. 10 is a cross-sectional view of the head cover 24 and the cylinder head 22 with the spark plugs 61*a* to 61*d* and the separated coils 62*a* and 62*b* attached in the double ended ignition coil configuration.

The plurality of sparks plugs 61*a* to 61*d* of the double ended ignition coil configuration is plugged into the respective plurality of plug holes 27*a* to 27*d*. More specifically, the first spark plug 61*a* is plugged into the first plug hole 27*a*. The second spark plug 61*b* is plugged into the second plug hole 27*b*. The third spark plug 61*c* is plugged into the third plug hole 27*c*. Finally, the fourth spark plug 61*d* is plugged into the fourth plug hole 27*d*.

The first spark plug is connected to the first separated coil 62*a* via a first cable 63*a*. The fourth spark plug 61*d* is connected to the first separated coil 62*a* via fourth cable 63*d*. Accordingly, the first separated coil 62*a* supplies electricity to the first spark plug 61*a* and the fourth spark plug 61*d*. The second spark plug 51*b* is connected to the second separated coil 62*b* via a second cable 63*b*. The third spark plug 51*c* is connected to the second separated coil 62*b* via a third cable 63*c*. Accordingly, the second separated coil 62*b* supplies electricity to the second spark plug 51*b* and the third spark plug 51*c*.

The first separated coil 62*a* is attached at the second attachment portion 34*a*. The first separated coil 62*a* includes a coil body 621, a first fixed portion 622, and a second fixed portion 623. The coil body 621 houses windings and an iron core (not shown), and increases the voltage input thereto. The coil body 621 is located beside the head cover 24.

The first fixed portion 622 protrudes from the upper surface of the coil body 621. The second fixed portion 623 protrudes from the lower surface of the coil body 621. The first fixed portion 622 and the second fixed portion 623 are configured to attach the first separated coil 62*a* to the second attachment portion 34*a*. The first fixed portion 622 is secured to the first support portion 341. The second fixed portion 623 is secured to the second support portion 342. Each fixed portion 622 and 623 includes a hole provided therein so that the bolts (not shown) used to attach the first separated coil 62*a* to the second attachment portion 34*a* pass through the hole in each fixed portion 622 and 623.

As illustrated in FIG. 10, a first plug boot 625*a* is connected to the first cable 63*a*. The first plug boot 625*a* includes a through hole, and the end portion of the first spark plug 61*a* is inserted into the through hole in the first plug boot 625*a*. The fourth plug boot 625*d* is connected to the fourth cable 63*d*. The fourth plug boot 625*d* includes a through hole, and the end portion of the fourth spark plug 61*d* is inserted into the through hole in the fourth plug boot 625*d*.

The second plug boot 625*b* is connected to the second cable 63*b*. The second plug boot 625*b* includes a through hole, and the end portion of the second spark plug 61*b* is inserted into the through hole in the second plug boot 625*b*. The third plug boot 625*c* is connected to the third cable 63*c*. The third plug boot 625*c* includes a through hole, and the end portion of the third spark plug 61*c* is inserted into the through hole in the third plug boot 625*c*.

The first through fourth plug boots 625*a* to 625*d* are arranged inside the trench 28. The first through fourth plug boots 625*a* to 625*d* are preferably made of an insulating material such as rubber.

The second spark plug 51*b*, third spark plug 51*c*, and the second separated coil 62*b* have the same configuration as the first spark plug 51*b*, the fourth spark plug 51*d*, and the first separated coil 62*a*, and therefore a detailed explanation thereof will be omitted.

A third cable holder 64*a* is preferably attached to the third attachment portion 35*a* to hold cables. A fourth cable holder 64*b* is preferably attached to the third attachment portion 35*b* to hold cables. The third cable holder 64*a* holds the first cable 63*a* and the second cable 63*b*. The fourth cable holder 64*b* holds the third cable 63*c* and the fourth cable 63*d*.

Figure 11:
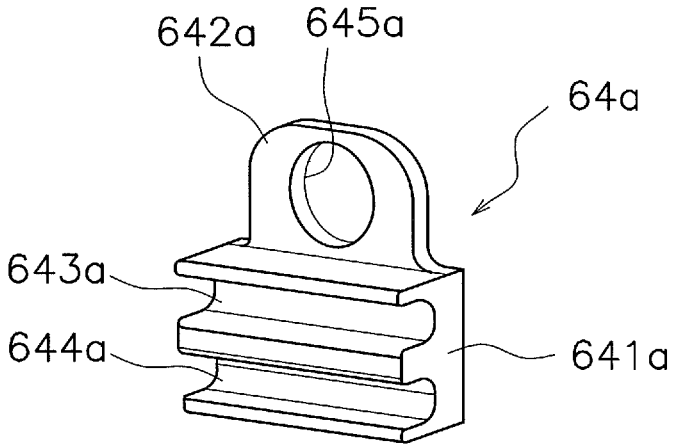
FIG. 11 is a perspective view of a third cable holder.

FIG. 11 is a perspective view of the third cable holder 64*a*. The third cable holder 64*a* includes a main section 641*a* and a flange 642*a*. The main section 641*a* includes a first groove 643*a* and a second groove 644*a* configured to hold cables. The first cable 63*a* is held in the first groove 643*a*. The second cable 63*b* is held in the second groove 644*a*. The flange 642*a* is provided with a hole 645*a*. The projection 351 on the third attachment portion 35*a* is inserted into the hole 645*a* in the flange 642*a*. The first groove 643*a* and second groove 644*a* are provided in the surface on one side of the main section 641*a* and a projection (not shown) is provided on the surface on the other side of the main section 641*a*. The projection engages with a recess 352 in the third attachment portion 35*a* to prevent the rotation of the third cable holder 64*a*. The fourth cable holder 64*b* preferably has the same configuration as the third cable holder 64*a*, and therefore a detailed explanation thereof will be omitted.

The boat propulsion device according to the described preferred embodiments include the following features.

When spark plugs 51*a* to 51*d* are used with the engine 6 in the coil-on-plug configuration, the plurality of integrated coils 52*a* to 52*d* which correspond to the plurality of spark plugs 51*a* to 51*d* are preferably each attached to the plurality of first attachment portions 33*a* to 33*d*. Furthermore, when the spark plugs 61*a* to 61*d* are used in the double ended ignition coil configuration, the separated coils 62*a* and 62*b* shared among the plurality of spark plugs 61*a* to 61*d* are preferably attached at the second attachment portions 34*a* and 34*b*. Consequently, both of the spark plugs for the coil-on-plug configuration and the spark plugs for the double ended ignition coil configuration may be used, and the standardizing of components leads to reduced production costs.

The trench 28 in the head portion 20 connects the plurality of plug holes 27*a* to 27*d* to each other. Even if the plug boots 525*a* to 525*d* for the integrated coils 52*a* to 52*d* and the plug boots 625*a* to 625*d* connected to the separated coils 62*a* and 62*b* have a different shape, the trench facilitates attachment of the plug boots to the spark plugs.

The head portion 20 includes a rib 29 arranged between plug holes 27*c* and 27*d* in the trench 28. As a result, when a worker plugs the plug boot 525*d* or the plug boot 625*d* into the trench 28, the rib 29 prevents the worker from misplacing the plug boot 525*d* or the plug boot 625*d* between the plug holes 27*c* and 27*d*. Moreover, the bolt seats 30*a* to 30*d* provided in the trench 28 prevent misplacement of the plug boots between the other plug holes. The same kind of bolt seats as the bolt seats 30*a* to 30*d* may be substituted for the rib 29 to prevent the plug boot 525*d* or the plug boot 625*d* from being placed between the plug holes 27*c* and 27*d*.

The plurality of imaginary lines L1a to L1d for the first attachment portions 33*a* to 33*d* preferably slant with respect to the vertical direction. Therefore, the plurality of integrated coils 52*a* to 52*d* will preferably slant with respect to the vertical direction. Slanting the plurality of integrated coils allows a compact arrangement of the plurality of integrated coils 52*a* to 52*d* in the head cover 24.

The first cable holder 54*a* and the second cable holder 54*b* are preferably attached to the third attachment portions 35*a* and 35*b*. Alternatively, the third cable holder 64*a* and the fourth cable holder 64*b* may be attached to the third attachment portion 35*a* and 35*b*. Therefore, the cables are held securely. Additionally, the third attachment portions 35*a* and 35*b* are preferably shared to attach the first cable holder 54*a* and the second cable holder 54*b*, and to attach the third cable holder 64*a* and the fourth cable holder 64*b*.

The above description refers to various preferred embodiments of the present invention, but the present invention is not limited to the above preferred embodiments and may be modified in various ways insofar as the modifications do not depart from the spirit and scope of the invention.

While the above preferred embodiments refer to an outboard motor as an example of a boat propulsion device, the present invention may be used in other types of boat propulsion devices such as stern drives.

Furthermore, the number of spark plugs and plug holes need not be limited to four as in the above preferred embodiments. The number of spark plugs or plug holes may be fewer or greater than four. Furthermore, the number of integrated coils need not be limited to four as in the above preferred embodiments. The number of integrated coils may be fewer or greater than four. Further, the number of separated coils need not be limited to two as in the above preferred embodiments. There may be one, or more than three separated coils.

The imaginary lines L1a to L1d may be parallel or substantially parallel to the vertical direction. Alternatively, the imaginary lines L1a to L1d may be parallel or substantially parallel to the horizontal direction.

Without being limited to the above preferred embodiments, the position of the first attachment portions 33*a* to 33*d* may be varied. Without being limited to the above preferred embodiments, the position of the second attachment portions 34*a* and 34*b* may be varied. Without being limited to the above preferred embodiments, the position of the third attachment portions 35*a* and 35*b* may be varied. For example, the third attachment portions 35*a* and 35*b* may be provided in the cylinder head 22 and not in the head cover 24.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat propulsion device comprising:

an engine including a crankshaft extending in a vertical direction and ahead portion arranged horizontally adjacent to the crankshaft;

a drive shaft extending in the vertical direction and connected to the crankshaft; and a propeller shaft extending in a horizontal direction and connected to the drive shaft; wherein the head portion includes:

a plurality of plug holes aligned in the vertical direction and arranged parallel or substantially parallel to the crankshaft;

a plurality of first attachment portions arranged about a periphery of the plurality of plug holes, the plurality of first attachment portions configured to attach a plurality of integrated coils integrated with a plurality of spark plugs in a coil-on-plug configuration; and a second attachment portion provided separately from the plurality of first attachment portions, the second attachment portion configured to attach a separated coil connected via a plurality of cables to a plurality of spark plugs in a double ended ignition coil configuration.

2. The boat propulsion device according to claim 1, wherein the head portion includes a trench extending in the vertical direction, and the trench connects the plurality of plug holes to each other.

3. The boat propulsion device according to claim 2, wherein the head portion includes a rib arranged in the trench between at least two of the plurality of plug holes.

4. The boat propulsion device according to claim 1, wherein the plurality of first attachment portions include:

a plurality of first fastening holes and a plurality of second fastening holes corresponding to each of the plurality of plug holes;

each of the plurality of plug holes is arranged between a corresponding first fastening hole and a corresponding second fastening hole; and a plurality of imaginary lines connecting respective centers of the first fastening holes and the second fastening holes are slanted with respect to the vertical direction.

5. The boat propulsion device according to claim 1, wherein the head portion includes a third attachment portion configured to attach a cable holder configured to hold a cable.

6. The boat propulsion device according to claim 5, further comprising:

the plurality of spark plugs in the coil-on-plug configuration plugged into each of the plug holes;

the plurality of integrated coils attached to the plurality of first attachment portions, the plurality of integrated coils respectively integrated with the spark plugs;

a plurality of cables connected to each of the plurality of integrated coils; and the cable holder attached to the third attachment portion, the cable holder configured to hold the plurality of cables.

7. The boat propulsion device according to claim 5, further comprising:

the plurality of spark plugs in a double ended ignition coil configuration plugged into each of the plurality of plug holes;

the separated coil attached to the second attachment portion;

the plurality of the cables connecting the separated coil and the plurality of spark plugs in the double ended ignition coil configuration; and the cable holder attached to the third attachment portion, the cable holder configured to holding the plurality of cables.

* * * * *